US005239907A

United States, Patent [19]

Sugiyama et al.

[11] Patent Number: 5,239,907

[45] Date of Patent: Aug. 31, 1993

[54] MUTING DEVICE OF GRAND PIANO

[75] Inventors: Nobuo Sugiyama; Katuo Ito; Yasutoshi Kaneko, all of Hamamatsu, Japan

[73] Assignee: Yamaha Corporation, Hamamatsu, Japan

[21] Appl. No.: 706,580

[22] Filed: May 28, 1991

[30] Foreign Application Priority Data

May 28, 1990 [JP] Japan ..... 2-137649
May 30, 1990 [JP] Japan ..... 2-140715
Oct. 2, 1990 [JP] Japan ..... 2-264502

[51] Int. Cl.[5] ..... G10C 3/18
[52] U.S. Cl. ..... 84/239
[58] Field of Search ..... 84/236, 239, DIG. 7, 84/251

[56] References Cited

U.S. PATENT DOCUMENTS 1,289,449 12/1918 Hussey .
1,392,331 10/1921 Hussey .
4,774,868 10/1988 Finholm ..... 84/239
4,856,402 8/1989 Alexander ..... 84/239
4,860,626 8/1989 Tanaka et al. ..... 84/236
4,953,433 9/1990 Fandich et al. ..... 84/239

FOREIGN PATENT DOCUMENTS 75866 6/1894 Fed. Rep. of Germany .
112663 8/1900 Fed. Rep. of Germany .
588465 11/1933 Fed. Rep. of Germany .
1064325 8/1959 Fed. Rep. of Germany .
1547554 4/1967 Fed. Rep. of Germany .
402056 11/1974 U.S.S.R. .
624259 8/1978 U.S.S.R. .
201019 1/1980 U.S.S.R. .
917192 3/1982 U.S.S.R. .

*Primary Examiner*—Stanley J. Witkowski
*Assistant Examiner*—H. Kim
*Attorney, Agent, or Firm*—Spensley Horn Jubas & Lubitz

[57] ABSTRACT

A muting device for a piano includes a capstan screw, a support rail, a support, a jack, a shank rail, a hammer shank, a hammer and at least one string with respect to each key. Each key is divided into a back portion and a front portion with respect to the rotation axis. This front portion of the key is depressed by a performer, while the back portion of the key is inserted into a key driving mechanism of the grand piano. In addition, a transmitting member (e.g., another capstan screw) transmits force from the key to the hammer. The transmitting member is inserted between an upper surface of the key and a lower surface of the support. The transmitting member contacts the upper surface of the key between the capstan screw and a rotation center of the key, and it also contacts with the lower surface of the support between a position at which the capstan screw comes contacts the support and a position at which the jack is connected to the support. Using two capstan screws, it is possible to simulate the double action of the key of a grand piano. In non-key-depression state, a string striking stroke between the hammer and string is reduced to mute a piano sound.

3 Claims, 10 Drawing Sheets

MUTING DEVICE OF GRAND PIANO

BACKGROUND OF THE INVENTION

1. Field of the Invention

The present invention relates to a muting device, which may be utilized in a grand piano and which reduces normal tone volume of a piano sound when depressing a key of the piano.

2. Prior Art

FIG. 1 illustrates an example of the mechanical construction of the known key driving unit provided in a grand piano.

Before describing the conventional muting device, simple description will be given with respect to the key driving unit in conjunction with FIG. 1. Herein, 1 designates a key which is provided on a board 2 such that it can freely revolve about an axis "X" in vertical direction. The right side of FIG. 1, designates a front side of key 1 and the left side designates a back side of the key 1. On a support rail 3 positioned at the back side of the key 1, a support 4 is provided such that it can freely revolve about a pin 4*a* in vertical direction. Next, a support heel 5 is attached at the lower surface of the support 4 and it is positioned to be in contact with a capstan screw 4, so that an angular position of the support 4 is set. A swing edge portion of the support 4 is supported by a jack 7 which can be freely swung about a pin 7*a*.

In addition, 9 designates a shank rail to which a shank frange 10, is fixed. Further, a hammer 11 is attached to the shank frange 10, so that it can freely swing about a pin 11*a* provided at an edge portion of the shank frange 10. The hammer 11 is constructed by a hammer felt 13 and a shank portion 14. This hammer felt 13 strikes a string 12, while the shank portion 14 supports the hammer felt 13. When the key 1 is depressed, an edge portion of the jack 7 pushes the shank portion 14 via a roller 15 in an upward direction so that the shank portion 14 rotates.

Incidentally, 17 designates a damper which is operated by a back edge portion (not shown) of the key 1 by means of a damper lever 18 and a damper wire 19.

In the above-mentioned key driving unit, when the key 1 is depressed, the key 1 rotates about an axis X in a clockwise direction. Associated with the rotary movement of the key 1, the lower surface of the support 4 is pushed upward by the capstan screw 6 and support heel 5 so that the support 4 rotates about the pin 4*a* in a counterclockwise direction. Due to this rotation of the support 4, the hammer shank portion 14 is pushed upward by means of the jack 7 and roller 15. As a result, the hammer 11 rotates about the pin 11*a* in a clockwise direction, so that its hammer felt 13 strikes the string 12, by which the piano sound is generated.

During generation of the piano sound, the damper 17 is operated by the back edge portion of the key 1 by means of the damper lever 18 and damper wire 19 so that it is lifted up. Then, the depressing pressure applied to the key 1 is released so that the key 1 is returned to its original position. At this time, the damper 17 falls downward and thereby touches with the string 12 so that generation of the piano sound is suspended.

FIG. 2 illustrates positional relationship between the key 1 and support 4.

Herein, the support 4 is moved accompanied with the key depression as described above. In addition, the front side portion of the key 1 is moved in connection with the swing edge portion of the support 4 (see pin 7*a* which supports the jack 7) as shown in FIG. 3. As shown in FIG. 3, upward movement of the swing edge portion of the support 4 is increased proportional to the downward movement of the front side portion of the key 1.

The upward movement of the pin 7*a* depends on balance ratio A:B of the key 1 and balance ratio C:D of the support 4. Herein, "A" designates distance between the front edge of key 1 and supporting point X, while "B" designates distance between the supporting point X and capstan screw 6. In addition, "C" designates distance between the rotation center 4*a* of the support 4 and the point at which the support 4 contacts with the capstan screw 6, while "D" designates distance between the rotation center 4*a* and pin 7*a*.

According to a first mechanism employed in the conventional muting device, the position of the hammer 11 is shifted in a horizontal direction (i.e., key disposing direction in the keyboard of the piano) so as to reduce the number of the strings to be struck so that the tone volume is muted.

According to a second simple mechanism employed in the conventional muting device, a muffler felt and the like is inserted between the string 12 and hammer 11 so as to reduce the striking force of the hammer 11.

In the above-mentioned first mechanism of the conventional muting device, the tone color can be changed. However, there is a drawback in that the tone volume cannot be always reduced.

In the second mechanism of the conventional muting device, the tone volume can be reduced in the higher pitch range. However, the tone volume in the middle lower pitch ranges cannot be reduced to the expected level. In addition, the tone color of the overtone having a higher harmonic frequency is muted, thus, there is a drawback in that the muted sound must be heard without tension. Moreover, when simulating the muting operation of the foregoing muffler felt in the automatic performance apparatus, it is impossible to reproduce the muting effect due to the reaction of the felt, which deteriorates the simulation accuracy of the automatic performance apparatus.

Most of the upright pianos employ the muting device having the mechanism in which, to reduce the string-striking-distance, the hammer 11 is positioned closer to the string 12. If such muting device is employed in the grand piano, reaction force of the hammer 11 cannot be transmitted to the key 1, so that due to the weight balance of the key 1, the back portion of the key 1 with respect to the supporting point X is lifted up. Thus, the back edge portion of the key 1 lifts up the damper lever 18, which raises a drawback in that the damper function cannot be accomplished. In an initial state of the key depression, the hammer 11 does not move (which is called "lost motion"), which raises another drawback in that the key touch feeling is deteriorated.

SUMMARY OF THE INVENTION

It is accordingly a primary object of the present invention to provide a muting device of the grand piano capable of muting the piano sound without damaging damper function.

It is another object of the present invention to provide a muting device of the grand piano by which it is possible to obtain the touch feeling without providing a lost motion for the hammer so that high-speed and continuous automatic performance can be carried out smoothly.

In a first aspect of the present invention, there is provided a muting device of a grand piano comprising:

a key arranged such that it can freely swing in a vertical direction about a rotation axis provided on a board portion of the grand piano, the key having a longitudinal shape which is divided into a back portion and a front portion with respect to the rotation axis, wherein the front portion of the key is depressed by a performer, while the back portion of the key is inserted into a key driving mechanism of the grand piano;

a capstan member projecting from a predetermined position on the back portion of the key;

a support arranged along with a support rail above the back portion of the key such that it can freely rotate in vertical direction, wherein when the capstan member comes into contact with a lower surface of the support, the support being rotated responsive to rotary movement of the key about another rotation axis which is provided at a connection point between the support and the support rail;

a jack interconnected with a tip edge portion of the support such that it can freely rotate, the jack, responsive to rotary movement of the support, transmitting key depressing force to be applied to the key by the performer to a hammer which strikes a string; and a transmitting member for transmitting key depressing force from the key to the hammer, the transmitting member being inserted between an upper surface of the key and a lower surface of the support, the transmitting member contacting with the upper surface of the key at a position between the capstan member and the rotation center of the key and contacting with the lower surface of the support at a position placed between a position at which the capstan member comes into contact with the support and a position at which the jack is connected to the support.

In a second aspect of the present invention, there is provided a muting device of grand piano comprising:

a key which is arranged such that it can freely swing in vertical direction about a rotation axis provided on a board portion of the grand piano, the key having a longitudinal shape which is divided into a back portion and a front portion with respect to the rotation axis, wherein the front portion of the key is depressed by a performer, while the back portion of the key is inserted into a key driving mechanism of the grand piano;

a hammer shank which is interconnected with a shank rail provided on the board portion of the grand piano such that it can freely rotate in vertical direction, the hammer shank supporting a hammer which strikes a string;

a key-depressing-force-transmitting-mechanism which is inserted between and contacted with the key and the hammer shank so as to transmit key depressing force applied to the key by the performer to the hammer shank;

a string-striking-stroke-reducing-means for, in non-key-depression state, rotating the hammer shank to thereby reduce a string striking stroke by moving a set position of the hammer shank toward the string by a predetermined distance; and a load applying means for, when the string striking stroke is reduced, applying a predetermined load to the back portion of the key to thereby hold the key at a predetermined non-key-depression position.

BRIEF DESCRIPTION OF THE DRAWINGS

Further objects and advantages of the present invention will be apparent from the following description, reference being had to the accompanying drawings wherein preferred embodiments of the present invention are clearly shown.

In the drawings.

DESCRIPTION OF THE PREFERRED EMBODIMENTS

Figure 1:
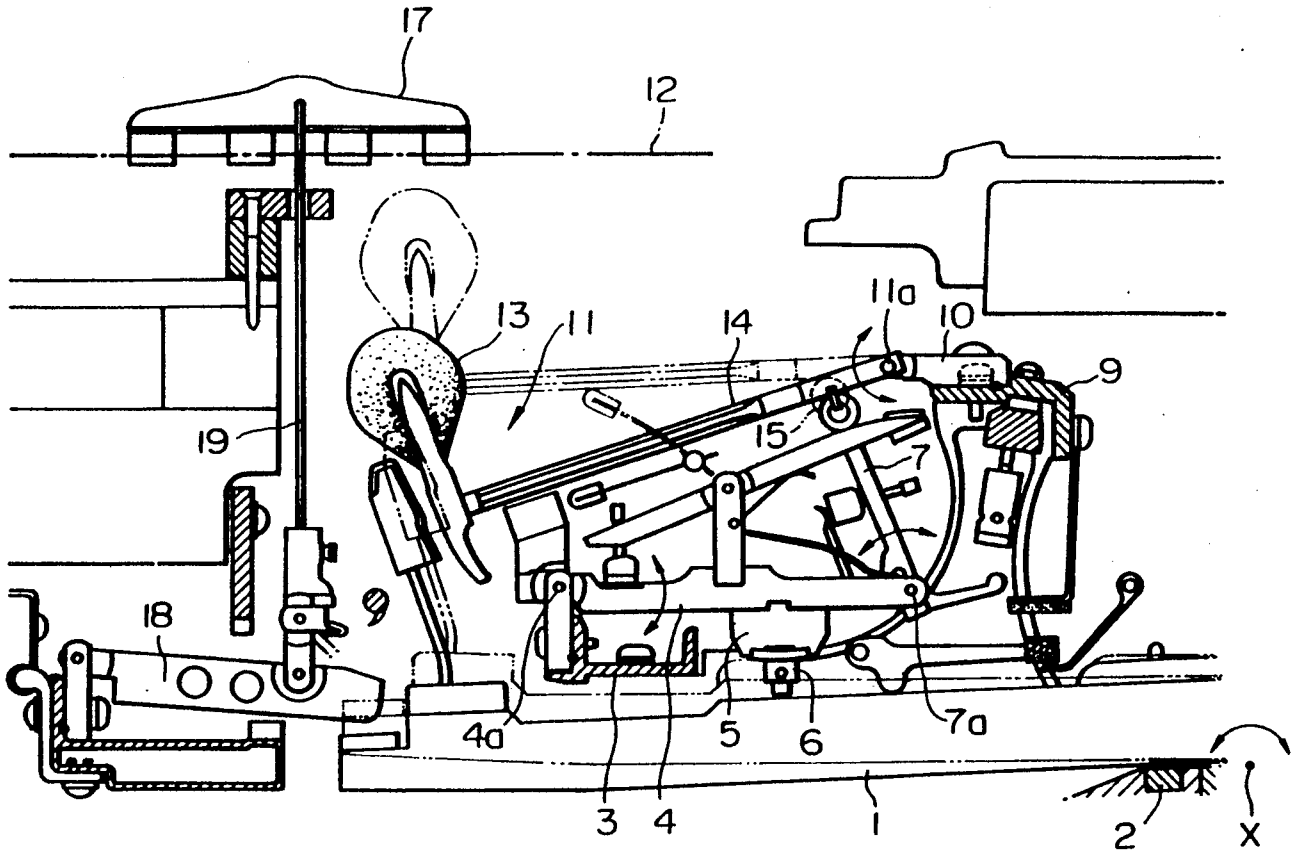
FIG. 1 (PRIOR ART)
FIG. 1 is a sectional side view illustrating a mechanical construction of the conventional key driving unit employed in the grand piano.
Figure 2:
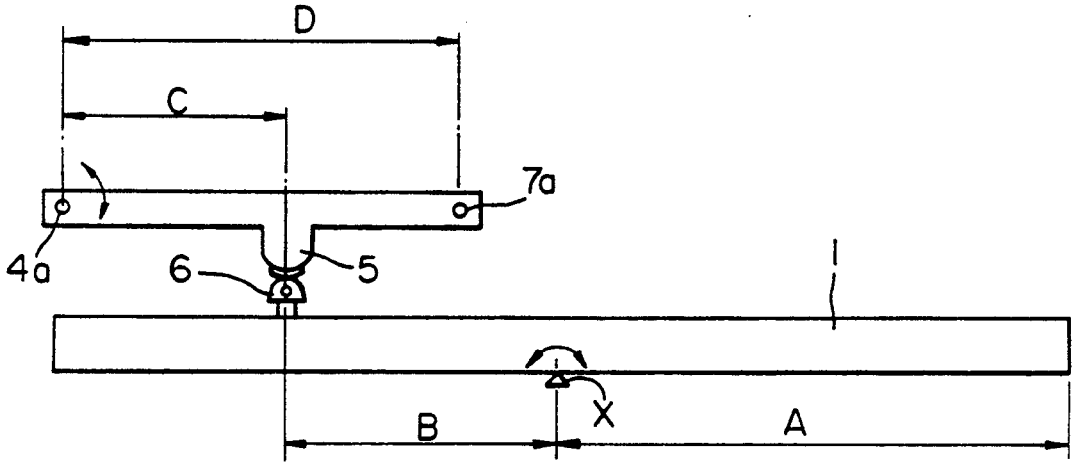
FIG.2 (PRIOR ART)
FIG. 2 is a drawing showing operational relationship between the key and support of the grand piano.

Next, description will be given with respect to the preferred embodiments of the present invention by referring to FIGS. 4 to 13, wherein parts identical to those shown in FIGS. 1 and 2 are designated by the same numerals, hence, description thereof will be omitted.

[A] First Embodiment

First, description will be given with respect to the first embodiment of the present invention by referring to FIGS. 4 to 7.

(1) Configuration

Figure 4:
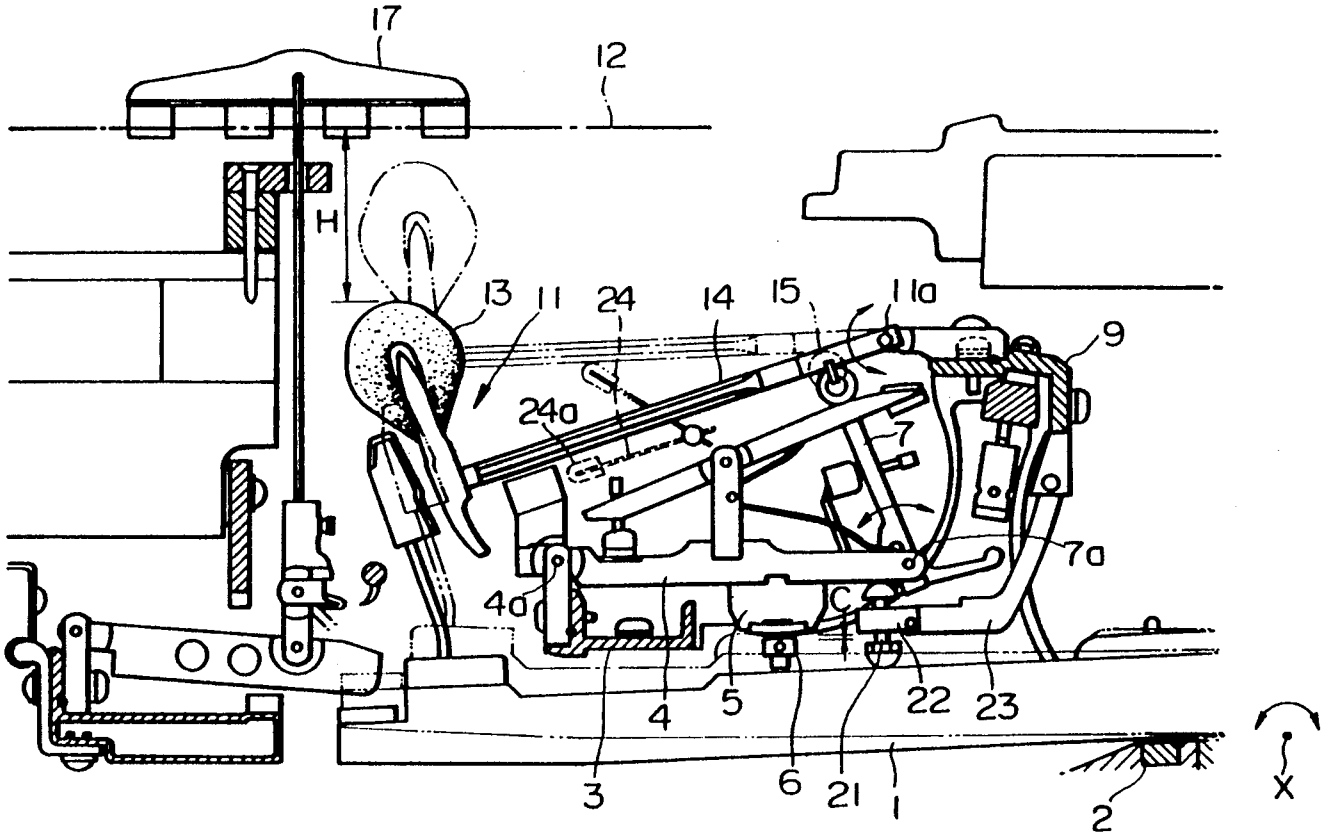
FIG. 4 is a sectional side view illustrating a string striking mechanism of a muting device of grand piano according to a first embodiment of the present invention.

As comparing to the prior art shown in FIG. 1, the first embodiment shown in FIG. 4 provides two capstan screws, i.e., first capstan screw 6 and second capstan screw 21. This second capstan screw 21 is arranged in contact with the upper surface of the key 1 between the first capstan screw 6 and the rotation center X of the key 1, and it is also arranged in contact with the lower surface of the support 4 between the first capstan screw 6 and jack pin 7*a*. As described above, the second capstan screw 21 is inserted between the upper surface of the key 1 and the lower surface of the support 4 such that it can freely move in upward/downward direction. Herein, length of each capstan screw 21 can be adjusted independently, by which motion of each key 1 can be independently transmitted to the support 4. In addition, a capstan button of the capstan screw 21 is supported by a holder 22 such that it can freely move in upward/-downward direction (see FIG. 5), wherein this holder 22 is attached at a tip edge portion of an arm 23 which is supported by the foregoing shank rail 9.

The above-mentioned arm 23 can freely rotate according to needs. Due to such rotation of the arm 23, it is possible to switch over the performance state by selecting one of two performance states, i.e., muting performance state and normal performance state. Herein, the muting performance state designates a state wherein the second capstan screw 21 is inserted between the key 1 and support 4 as shown in FIG. 1 to thereby mute the piano sound, and this muting performance state is released when selecting the normal performance state. As a switching means for switching over the performance state, it is possible to employ one of the following three mechanisms (of which detailed constructions are omitted in drawings). According to a first mechanism, the arm 23 is manually rotated by use of a knob, while according to a second mechanism, the arm 23 is interlocked with a pedal mechanism (not shown) so that the arm 23 is rotated by a pedal operation. Further, according to a third mechanism which is employed in case of the automatic performance, it is possible to employ an actuator drive (e.g., geared-motor-drive) under MPU control.

Incidentally, as shown by dotted lines in FIG. 4, it is possible to further provide a lift arm 24 which is designed to lift up the hammer shank 14 according to needs. In this case, an elastic member 24*a* made of the felt material and the like is provided at a tip edge portion thereof. Thus, it is possible to obtain the so-called load reducing effect and transmission cut-off effect. Herein, load to be occurred due to the rotation of the arm 23 can be reduced by the load reducing effect, while impact to be occurred due to return action of the hammer in the muting performance period is prevented from being transmitted to the action mechanism by the tranmission cut-off effect.

(2) Operation

Next, description will be given with respect to the operation which is effected to the muting device by the key driving unit in connection with the muting performance and normal performance respectively.

(a) Muting Performance

At first, the manual operation, pedal operation or the like is adequately carried out to rotate the arm 23 so that the second capstan screw 21 is inserted between the key 1 and support 4 as shown in FIG. 4.

Herein, the second capstan screw 21 is adjusted in advance such that its lower and upper edges come in contact with the key 1 and support 4 respectively. Due to the adjustment of the second capstan screw 21, a small clearance "c" is formed between the first capstan screw 6 and support heel 5. Thus, under operation of the second capstan screw 21, the support 4 is revolved by the predetermined angle in counterclockwise direction as comparing to its position in the normal performance state. This rotation of the support 4 activates the hammer 11 to be revolved in clockwise direction by the jack 7 and roller 15, so that key depressing stroke (or string striking stroke) H is reduced.

In this case, weight of the hammer 11 is transmitted to the support 4 via the roller 15 and jack 7, and it is further transmitted to the key 1 via the second capstan screw 21. Thus, in the key depression, the key 1 is revolved against its own weight in counterclockwise direction, so that position of the key 1 is set at an initial position as shown by a solid line in FIG. 4. In addition, the damper 17 is positioned such that it comes in contact with the string 12.

In the above-mentioned state, when the key depression is made, the key 1 is revolved about the axis X in clockwise direction. Associated with the lift-up motion of the back portion of the key 1, in an initial period of the key depression, the key depressing force is transmitted toward the support 4 by the second capstan screw 21.

Figure 3:
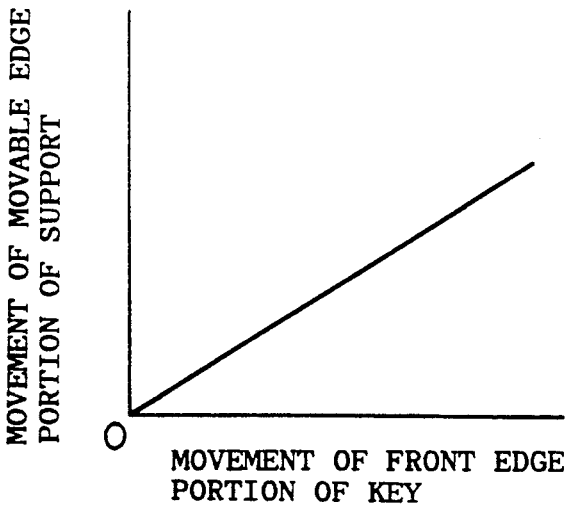
FIG.3 (PRIOR ART)
FIG. 3 is a graph showing a relationship between the movements of the key and support.
Figure 6:
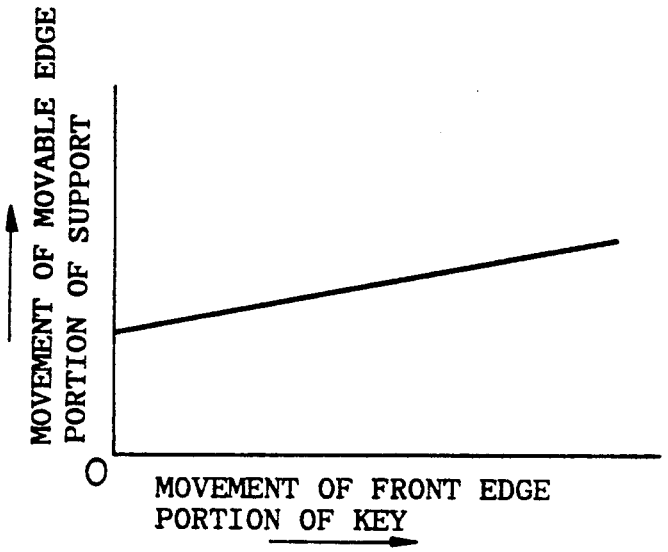
FIG. 6 is a graph showing a relationship between movements of the key and support in the case where rotation of the key is transmitted to the support by use of the key-depressing-force-transmitting-means.

In this case, relationship as shown by FIG. 6 is established between movements of the front edge portion of the key 1 and swing edge portion (or movable edge portion, i.e., pin 7*a* which supports the jack 7) of the support 4. As comparing to the key-depression transmitting characteristic as shown in FIG. 3 in which the key depressing force is transmitted by means of the first capstan screw 6, the key-depression transmitting characteristic of the present embodiment as shown in FIG. 6 has a lifted-up initial level of the key 1 and a small inclination. The reason why the key-depression transmitting characteristic of the present embodiment has a small inclination is that the present embodiment is designed to reduce the length between the supporting point X of the key 1 and second capstan screw 21 but it is also designed to enlarge the length between the rotation center 4*a* of the support 4 and second capstan screw 21.

Now, description will be given with respect to an example wherein a point at which the first capstan screw 6 contacts with the support heel 4 is adjusted within a range of vertical movement of the key 1. In this example, range of the vertical movement of the front edge portion of the key 1 (i.e., rightmost edge portion, not shown, of the key 1 in FIG. 4) is set at 10 mm. At first, the key depressing force is transmitted to the support 4 by the second capstan screw. After the first capstan screw 6 contacts with the support 4, the key depressing force is transmitted to the support by the first capstan screw 6.

Figure 7:
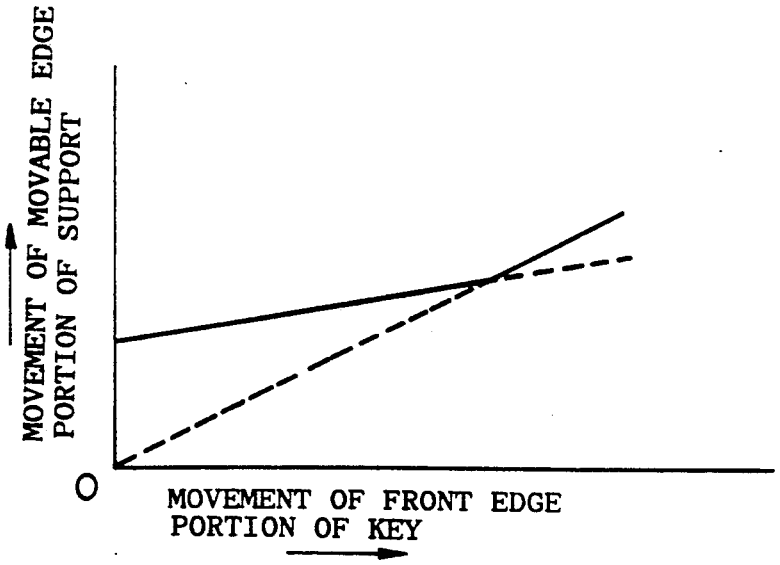
FIG. 7 is a graph showing a relationship between the key and support in the first embodiment.

FIG. 7 shows the above-mentioned double action of the key. The characteristic as shown in FIG. 7 is made by mixing the foregoing two characteristics shown in FIGS. 3 and 6. According to the mixed characteristic of FIG. 7, moving velocity of the swing edge portion (i.e., jack pin 7*a*) of the support 4 is relatively slow in an initial period of the key depression, however, it turns to be a high velocity corresponding to the moving velocity of the swing edge portion of the conventional support after the first capstan screw 6 comes in contact with the support 4. Due to the short period of time in which the moving velocity of the support 4 becomes high, the support 4 cannot be accelerated to the satisfactory velocity. Moreover, due to the shortened key depressing stroke H, striking force of the hammer 11 which strikes the string 12 is weakened, resulting that the tone volume is muted.

Moreover, the present embodiment is designed such that weight of the hammer 11 is always loaded to the key 1 via the jack 7, support 4 and the like. Thus, it is possible to obtain a good key-touch feeling, and it is also possible to prevent the key 1 from being moved at a time when the performer does not want to depress the key.

As described above, the present embodiment employs the double action in the key depression wherein the member for transmitting motion of the key 1 is changed in response to the depression of the key 1 because of the following reasons.

One reason is that the lower edge portion of the second capstan screw 21 which is newly provided in the present embodiment comes in contact with the upper surface of the key 1 between the first capstan screw 6 and rotation center X.

More specifically, the second capstan screw 21 contacts with the key 1 at a position which is closer to the rotation center as comparing to the first capstan screw 6. In other words, when the key 1 is to be revolved about the axis X, distance between the second capstan screw 21 and key 1 is small as comparing to distance between the first capstan screw 6 and key 1. Therefore, in an initial state of the rotary motion of the key 1 to be occurred in the key depression, the clearance "c" is formed between the first capstan screw 6 and support 4. Hence, even if the key depressing force cannot be transmitted by means of the first capstan screw 6, as the rotary motion of the key 1 progresses, there is a chance in that the first capstan screw 6 will be in contact with the support 4. Then, after the first capstan screw 6 contacts with the support 4, the key depressing force is transmitted by means of the first capstan screw 6.

Another reason is that the upper edge portion of the second capstan screw comes in contact with the lower surface of the support 4 between the first capstan screw 6 and jack connecting portion (i.e., jack pin *7a*).

More specifically, the second capstan screw 21 contacts with the support 4 at a position which is closer to the swing edge portion of the support 4 as comparing to the first capstan screw 6. Even if the support 4 is pushed upward by the first and second capstan screws 6, 21 with the same force so as to be rotated, rotation of the support 4 to be occurred under operation of the first capstan screw 6 is relatively large as comparing to that of the support 4 to be occurred under operation of the second capstan screw 21 because the first capstan screw 6 is positioned close to the rotation center X.

As described before, when the key 1 is subject to the rotary motion about the rotation center X, the distance between the first capstan screw 6 and key 1 is larger than the distance between the second capstan screw 21 and key 1. As a result, in an initial state of the rotary action of the key 1, the key depressing force is transmitted toward the support 4 by means of the second capstan screw 21. Thereafter, however, the key depressing force is transmitted by means of the first capstan screw 6.

(b) Normal Performance

First, a manual operation (or pedal operation) is made to rotate the holder 22, thereby releasing the muting state wherein the second capstan screw 21 is inserted between the key 1 and support 4. Thus, the key driving unit of the present embodiment has the substantially same construction of the conventional key driving unit as shown in FIG. 1, by which the muting state is released so that the normal performance can be made.

Figure 8:
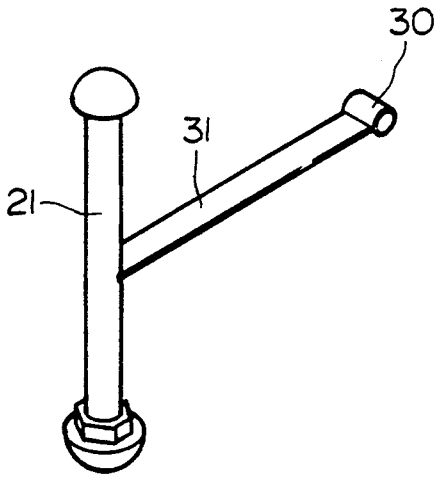
FIG. 8 is an enlarged perspective side view showing another supporting structure of the key-depressing-force-transmitting-means according to a modified example of the first embodiment.

FIG. 8 shows a modified example of the supporting structure of the second capstan screw 21.

Figure 5:
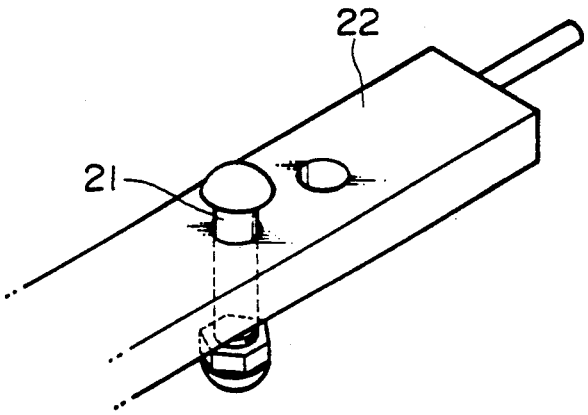
FIG. 5 is an enlarged perspective side view illustrating a supporting structure of a key-depressing-force-transmitting-means (i.e., a second capstan screw shown in FIG. 4)

The present embodiment can be modified to employ the supporting structure as shown in FIG. 5 wherein the second capstan screw 21 is supported by a plate spring 31 attached to a rotation axis 30 such that it can be freely moved in upward/downward direction. Herein, by rotating the rotation axis 30, it is possible to selectively set and release the muting state wherein the second capstan screw 21 is inserted between the key 1 and support 4.

In the above-mentioned modified example, the second capstan screw 21 is used as a means for transmitting the key depressing force between the key 1 and support 4. However, it is possible to use another member which is designed such that it can contact with the key and support and its length can be adjusted.

[B] Second Embodiment

Figure 9:
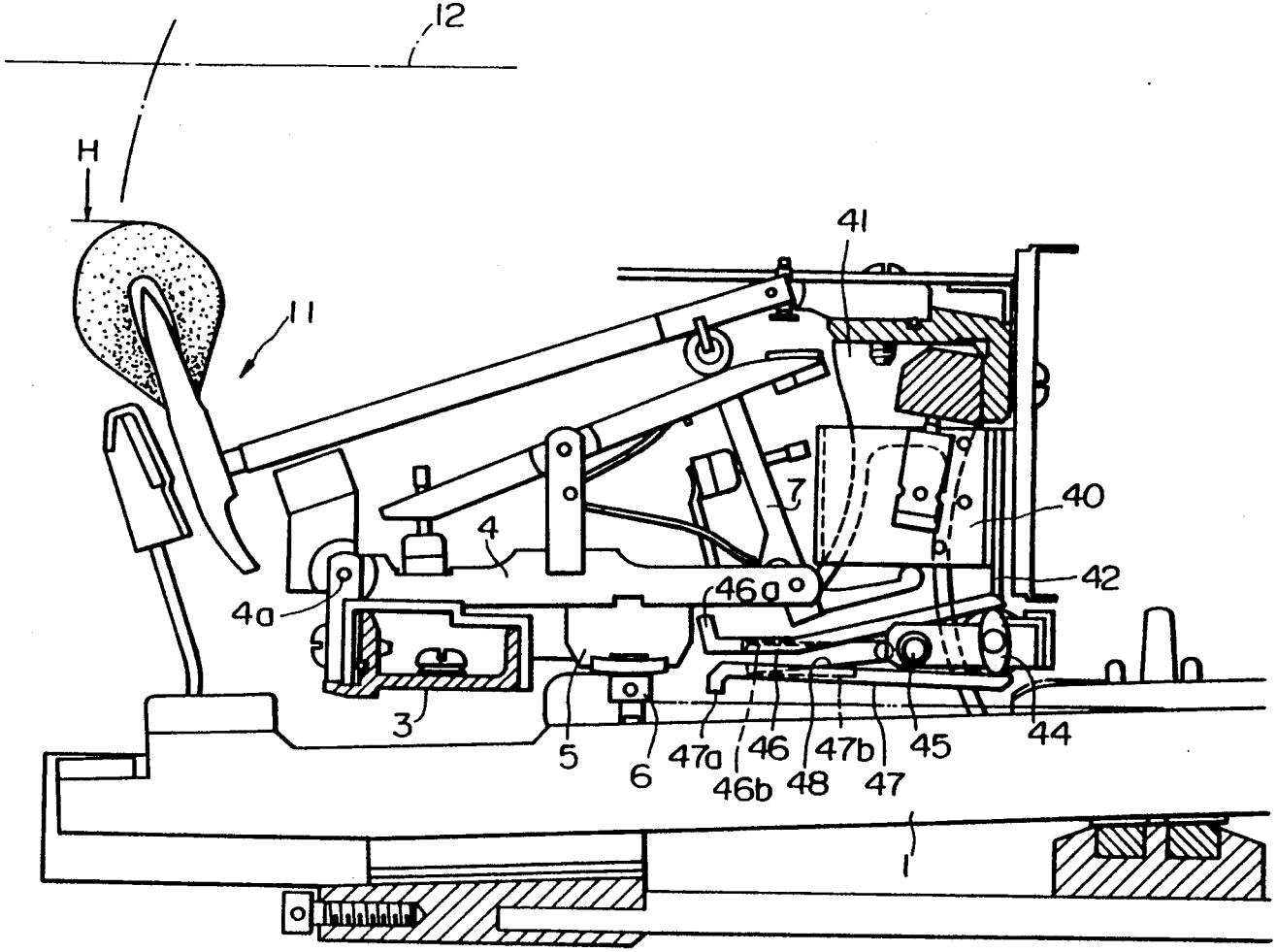
FIG. 9 is a sectional side view showing a string striking mechanism of a muting device of grand piano according to a second embodiment.
Figure 10:
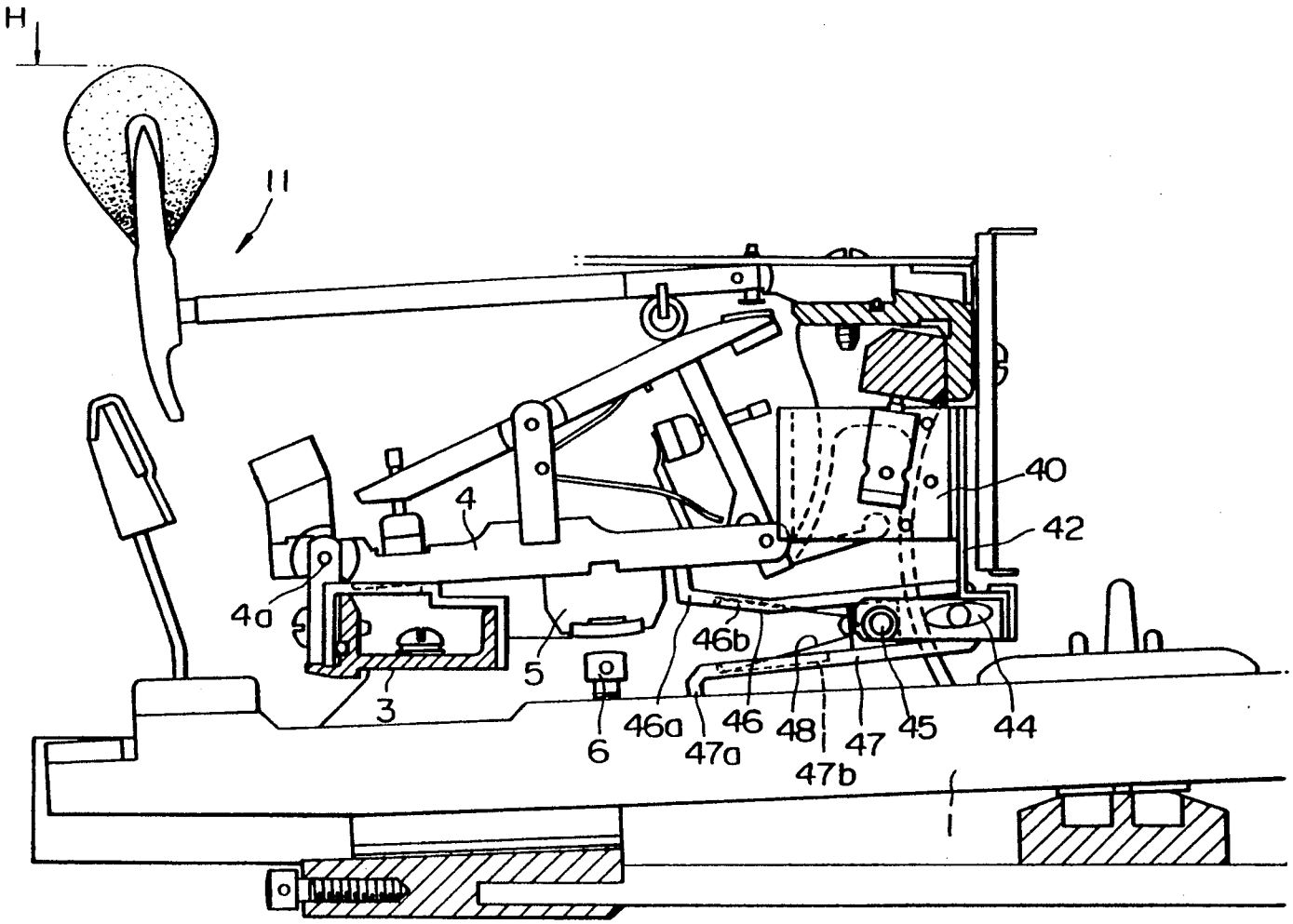
FIG. 10 is a sectional side view for explaining movement of the string striking structure shown in FIG. 9.
Figure 11:
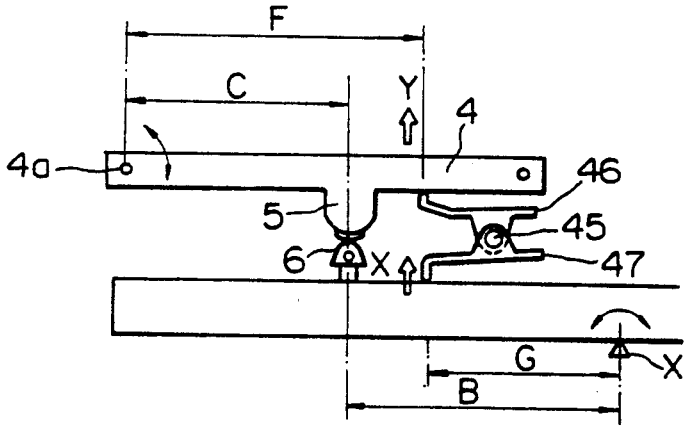
FIG. 11 is a drawing for explaining a relationship between movements of the key and support in the second embodiment.

FIGS. 9 to 11 illustrate the second embodiment of the present invention, wherein parts identical to those of the foregoing first embodiment will be designated by the same numerals, hence, description thereof will be omitted.

(1) Configuration

In FIG. 9, 40 designates a column fixed to an action bracket 41, and a bracket 42 is attached at a side portion of this column 40. In addition, a cam having an elliptic shape is provided at a side portion of the bracket 42 such that it can freely rotate about its axis. Further, an axis 45 is provided at a tip edge portion of the bracket 42, and both of an upper arm 46 and a lower arm 47 are rotably supported by this axis 45. Herein, a tip edge portion 46*a* of the upper arm 46 which is bent in upward direction is positioned such that it will come in contact with the lower surface of the support 4 between the first capstan screw 6 and jack connecting portion. On the other hand, a tip edge portion 47*a* of the lower arm 4 which is bent in downward direction is positioned such that it will come in contact with the upper surface of the key 1 between the supporting portion of first capstan screw 6 and rotation center X of the key 1. Hereinafter, the above-mentioned portions 46*a*, 47*a* will be respectively denoted as "upward bent portion" and "downward bent portion". Incidentally, a coil spring 48 is provided between the arms 46, 47 such that both edge portions thereof are respectively inserted in grooves 46*b*, 47*b* which are respectively formed on the arms 46, 47. Due to the elastic force of the coil spring 48 which is imparted between the arms 46, 47, the bent portions 46*a*, 47*a* are forced to be placed apart from each other. A set of the upper arm 46, lower arm 47 and coil spring 48 is provided for each key, so that total eighty-eight sets are provided for the piano. On the other hand, the elliptically shaped cam 44 which also has a longitudinal shape is provided for all keys of the piano, and it is interconnected with the key driving unit. In short, a set of the cam 44 and axis 45 is provided for each pitch range (i.e., each section).

By a rotation means (not shown, e.g., a manual mechanism using a lever or a rink, or an electric actuator using a motor or a rotary solenoid), the above-mentioned cam 44 is rotated by 90 degrees (see FIGS. 9 and 10).

(2) Operation

Next, description will be given with respect to an operation of the muting device provided in the above-mentioned key driving mechanism.

(a) Muting Performance

In this muting performance, the cam 44 is rotated as shown in FIG. 10. In this state, front edge portions (i.e., rightmost edge portion in FIG. 10) of the arms 46, 47 can freely rotate about the axis 45 without contacting with the cam 44. Herein, under operation of the coil spring 48, the arms 46, 47 are rotated about the axis 45 so that the upward bent portion 46*a* contacts with the support 4 and the downward bent portion 47*a* contacts with the key 1. At this time, the key 1 is set at the predetermined downward position, while the support 4 is lifted up. Accompanied with the lift-up motion of the support 4, the jack 7 is lifted up so that the string striking stroke H is reduced from 47.5±1.5 mm to 15±3 mm, for example. In this state, a clearance of 2 or 3 mm is formed between the first capstan screw 6 and support heel 5.

In the above-mentioned state, when the key 1 is depressed, the back portion thereof is started to be lifted up. At this time, until the first capstan screw 6 comes in contact with the support heel 5, the lower arm 47 rotates about the axis while being in contact with the key 1, which presses the coil spring 48 in upward direction. Thus, push-up pressure of the coil spring 48 to be applied to the support 4 becomes higher so that the support 4 will be slightly lifted up. Next, after the capstan screw 6 contacts with the support heel 5, the key depressing force of the key 1 is transmitted toward the support 4 via the capstan screw 6 and support heel 5, so that the support 4 will be lifted up. In this state, the arms 46, 47 rotate about the axis 45 while being in contact with the support 4 and key 1 respectively.

In the above-mentioned state, as shown in FIG. 11, a contact position between the upper arm 46 and support 4 is raised up by "Y", while another contact position between the lower arm 47 and key 1 is raised up by "X". Herein, "Y" is larger than "X", so that flexure of the coil spring 48, which is occurred at an initial state, is released during the key depression. Therefore, as the performer holds the key depressing force to the key 1, rebound force, which is imparted from the coil spring 48 to the key 1, becomes smaller.

In short, the following relationship is established between the above-mentioned 37 X" and "Y":

$$Y=(B*F)/(C*G)*X;$$

where "B" designates a length between the rotation center of key 1 and capstan screw 6, "F" designates a length between the rotation center of support 4 and the contact position at which the upper arm 46 contacts with the support 4, "C" designates a length between the rotation center of support 4 and the contact position at which the capstan screw 6 contacts with the support heel 6, and "G" designates a length between the rotation center of key 1 and the contact position at which the lower arm 47 contacts with the key 1 (see FIG. 11).

According to an actual example of the piano, these lengths are set as B=125 mm, F=82 mm, C=62 mm, G=105 mm, so that a ratio "Y/X" is equal to "1.57", for example.

Therefore, until the first capstan screw 6 comes in contact with the support heel 5, elastic load of the coil spring 48 is transmitted toward the performer's finger via the key 1. Due to this elastic load, the performer feels the rebound force of the key. After the first capstan screw 6 comes in contact with the support heel 5, the elastic load of the coil spring 48 is reduced to zero level. Thus, the present embodiment can offer the same key touch feeling of the existing grand piano which provides the so-called "let-off" resistance of the jack 7.

After the first capstan screw 6 contacts with the support heel 5, the moving velocity of the hammer 11 is accelerated. However, due to the reduced string striking stroke H, the hammer 11 cannot be accelerated to the desirable velocity, so that the string striking force of the hammer 11 which strikes the string 12 is weakened so as to lower the tone volume. Moreover, the present embodiment is designed such that weight of the hammer 11 is always applied to the key 1 by means of the arms 46, 47. Thus, it is possible to prevent the key touch feeling from being damaged as comparing to the actual key touch feeling of the existing grand piano. In addition, it is possible to prevent the key 1 from being moved when the performer does not want to depress the key 1, and it is also possible to avoid a sound suspension error due to an imbalance among the keys. Incidentally, it is possible to insert soundproof members, such as the felt which prevents a contact noise, between the bent portions 46*a*, 47*a* and support 4, key 1 respectively.

(b) Normal Performance

In this normal performance, the elliptically shaped cam 4 is rotated by 90 degrees so that the cam 4 is placed as illustrated in FIG. 9. In this state, the cam 44 pushes insides of the front edge portions of the arms 46, 47, therefore, the arms 46, 47 are rotated about the axis 45 against the elastic force of the coil spring 48 so that their bent portions 46*a*, 47*a* approach to each other.

In the above-mentioned state, however, the arms 46, 47 do not contact with the support 4 and key 1 respectively. When the key 1 is depressed, the back portion thereof is raised up so that the support 4 is raised up by the first capstan screw 6, therefore, the jack 7 is lifted up. Thus, the present embodiment carries out the normal string striking operation in which the hammer 11 strikes the string 12 to thereby produce a sound.

As described heretofore, in the present embodiment, members such as the upper arm 46, lower arm 47 and coil spring 48 are assembled together by means of the bracket 42, and they are built in the piano at the predetermined position. Therefore, such assembly configuration can be built in the existing grand piano and brand-new grand piano with ease.

[C] Third Embodiment (1) Configuration

Figure 12:
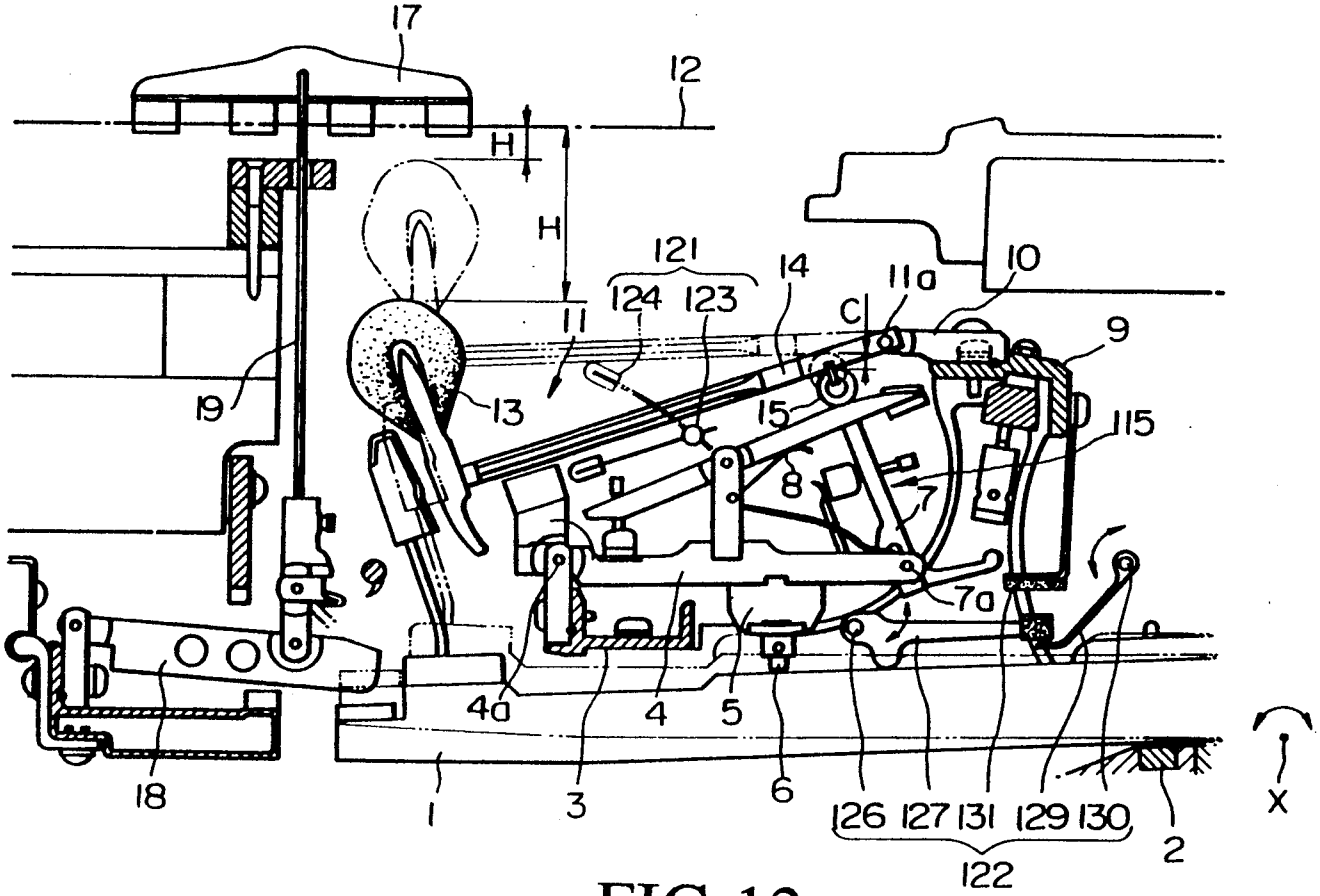
FIG. 12 is a sectional side view illustrating an essential part of a muting device of grand piano according to a third embodiment.

FIG. 12 illustrates a muting device of the grand piano according to a third embodiment of the present invention, wherein parts identical to those shown in the foregoing drawings are designated by the same numerals, hence, description thereof will be omitted.

In FIG. 12, 8 designates a repetition lever which is provided above the support 4, while 115 designates a key-depressing-force-transmitting-mechanism. In addition, there is provided a string-striking-stroke-reducing-means 121 which rotates the hammer shank 14 by certain angle to thereby approach the hammer 11 toward the string. Further, there is provided a load applying means 122 at a back side portion with respect to the rotation center of the key 1. This load applying means 122 applies the predetermined load to the key 1 so that the key 1 is held at the predetermined non-key-depression position in a period when the string striking stroke is reduced.

The above-mentioned string-striking-stroke-reducing-means 121 consists of a rotation shaft 123 and an arm 124. This rotation shaft 123 is provided at a position between the hammer shank 14 and repetition lever 8, and it has a longitudinal shape which reaches from first key (corresponding to the lowest pitch) and eighty-eighth key (corresponding to the highest pitch) in the piano. And, a tip edge portion of the arm 124 interconnecting with the rotation shaft 123 is designed to come in contact with the lower surface of the hammer shank 14, so that the arm 124 rotates about the rotation shaft 123.

Meanwhile, the load applying means 122 contains a supporting shaft 126, a loading arm 127, a lift-up lever 129, a shaft 130 and a stopper 131. Herein, the supporting shaft 126 is provided at a back side portion, departing from the rotation center X, above the key 1, and it has a longitudinal shape which extends from first key to eighty-eighth key. The loading arm 127, which is supported by the supporting shaft 126, is provided between the supporting shaft 126 and rotation center X of the key 1, so that it can rotate independently with respect to each key. Above the rotation center X of the key 1, the lift-up lever 129 is arranged such that it will engage with the tip edge portion of the loading arm 127 so as to lift up the loading arm 127. This lift-up lever 129 is supported by and rotated about the shaft 130 having a longitudinal shape extending in key disposing direction. The upper limit position to which the lift-up lever 129 rotates is set corresponding to a fixed position of the stopper 131, which is screwed to the shank rail 9, with which the tip edge portion of the loading arm 127 comes in contact. In order to ease the impact to be occurred when the loading arm 127 comes in contact with the stopper 131, the contacting portions of the loading arm 127 and stopper 131 are made of the flexible materials such as the felt.

Incidentally, the load applying means 122 is interlocked with the string-striking-stroke-reducing-means 121 by an interlocking means (not shown). When the string-striking-stroke-reducing-means 121 is activated (i.e., when the arm 124 contacts with the lower surface of the hammer shank 14 so that the hammer 11 is raised as shown by dashed line in FIG. 12), the lift-up lever 129 does not come in contact with the loading arm 127 so that weight of the loading arm 127 is loaded to the key 1 as shown in FIG. 12. On the other hand, 7hen the string-striking-stroke-reducing-means 121 is not activated (i.e., when the arm 124 does not come in contact with the hammer shank 14 as shown by solid line in FIG. 12), the lift-up lever 129 is rotated in clockwise direction so that the loading arm 127 is raised to prevent weight of the loading arm 127 from being loaded to the key 1.

In addition, a switching means (not shown) controls the string-striking-stroke-reducing-means 121 and load applying means 122 to switch over their state as described above.

(2) Operation (a) Muting Performance

Under operation of the switching means (interlocking with the pedal operation and the like), the rotation shaft 123 of the string-striking-stroke-reducing-means 121 is rotated in clockwise direction so that the tip edge portion of the arm 124 pushes up the lower surface of the hammer shank 14. Thus, the hammer 11 is raised so as to reduce the string striking stroke H as shown by dashed line in FIG. 12.

At this time, the shaft 130 of the load applying means 122 interlocking with the string-striking-stroke-reducing-means 121 is rotated in counterclockwise direction so as to release the lift-up operation of the arm 129, so that weight of the loading arm 127 is loaded to the key 1. Since weight of the loading arm 127 is added at the back side portion of the key 1, the key 1 is forced to be rotated against its own weight in counterclockwise direction, so that the key 1 is set in a normal non-key-depression state in which the front edge portion of the key 1 is slightly raised up.

In the above-mentioned state, when the performer depresses the key 1, the key 1 rotates about the rotation center X in clockwise direction so that the back portion thereof is raised. However, in an initial state of the key depression, the roller 15 is not in contact with the repetition lever 8 so that the key depressing force applied to the key 1 is not transmitted to the hammer shank 14 by means of the key-depressing-force-transmitting-mechanism 115. Then, after the repetition lever 8 comes in contact with the roller 15, the key depressing force is transmitted to the hammer shank 14 by means of the mechanism 115 so that the key depression is made. In this case, since the string striking stroke H is reduced so that the hammer 11 cannot be accelerated to the desirable velocity, it is possible to limit the tone volume in low level.

As described above, in the initial state of the key depression, weight of the hammer 11 is not transmitted to the key 1 due to a clearance "c" formed between the repetition lever 8 and roller 15. However, weight of the loading arm 127 is added to the key 1, by which it is possible to obtain the good key touch feeling as comparing to the conventional piano.

After the key depression is completed, the key 1 is rotated back to its original position due to weight of the loading arm 127. Therefore, it is possible to prevent the damper lever 18 from being raised by the back portion of the key 1. In addition, the damper 17 contacts with the string 12, thus, the present embodiment does not interfere the sound suspension effect of the damper 17.

(b) Normal Performance

Under operation of the switching means, the rotation shaft 123 is rotated in counterclockwise direction so as to release the pushing pressure of arm 124 applied to the hammer shank 14. At this time, the hammer shank 14 rotates in counterclockwise direction due to its own weight so that the roller 15 comes in contact with the repetition lever 8. Therefore, the string striking stroke H becomes substantially equal to that of the conventional key driving unit. Thus, the muting state is released, and it becomes possible to carry out the normal performance.

At the same time, the shaft 130 is rotated in clockwise direction, so that the lift-up lever 129 lifts up each loading arm 127. This prevents weight of the loading arm 127 from being added to the key 1, which offers the same key touch feeling as comparing to the conventional string striking mechanism.

[D] Modified Example

Figure 13:
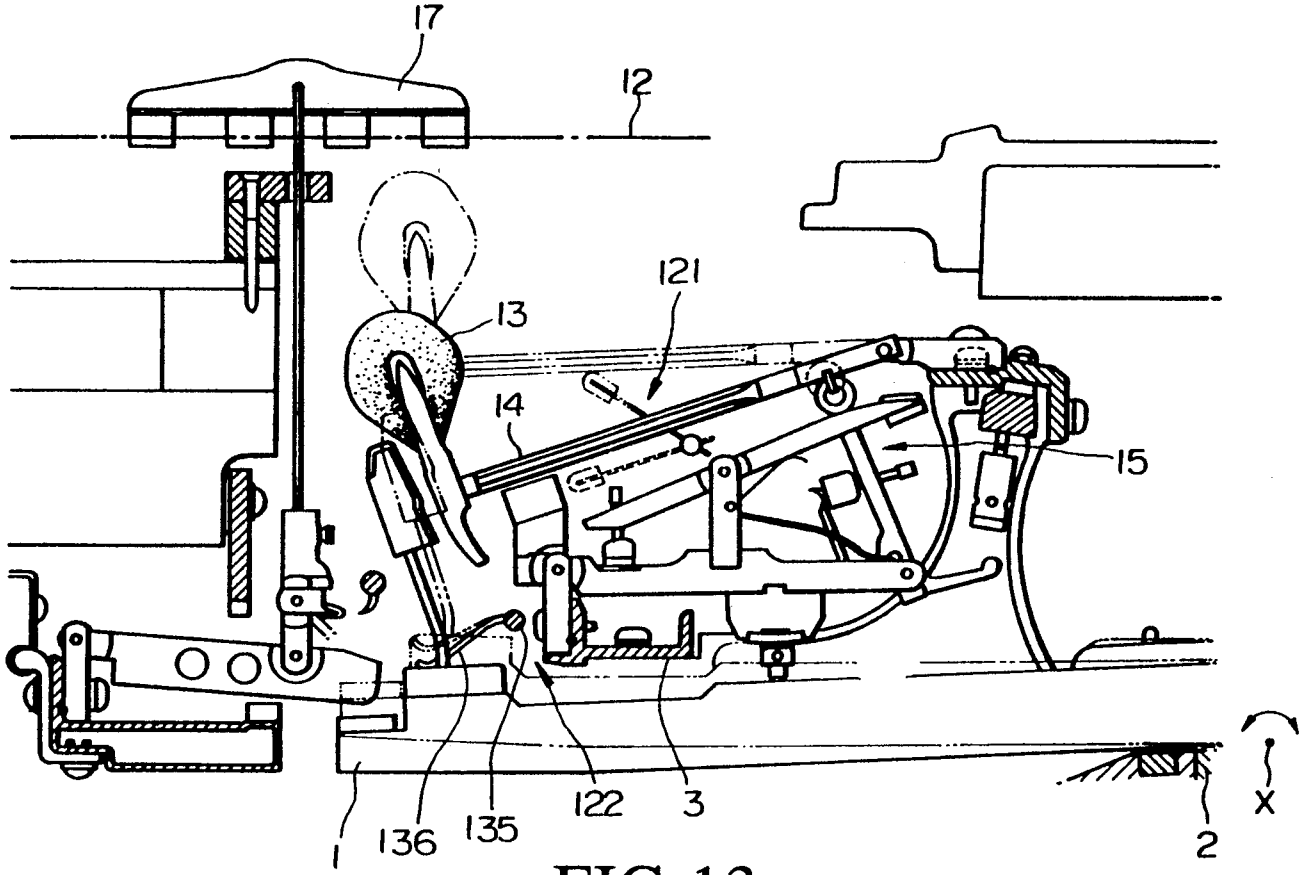
FIG. 13 is a sectional side view illustrating an essential part of a modified example of the third embodiment.

FIG. 13 illustrates a modified example of the third embodiment described above in conjunction with FIG. 12. In this example, elastic force of spring is employed as the load applying means 122.

More specifically, at a back side portion of the support rail 3, there is provided a fixed shaft 135 having a longitudinal shape which extends from first key to eighty-eighth key. In addition, a plate spring 135 is provided with respect to each key such that its one edge is fixed to the fixed shaft 135 and its another edge is attached to the upper surface of the back side portion of the key 1. Due to this plate spring 136, desirable load can be applied to the key 1 as similar to the foregoing third embodiment.

Lastly, this invention may be practiced or embodied in still other ways without departing from the spirit or essential character thereof as described heretofore. Therefore, the preferred embodiments described herein are illustrative and not restrictive, the scope of the invention being indicated by the appended claims and all variations which come within the meaning of the claims are intended to be embraced therein.

What is claimed is:

1. A muting device of a grand piano comprising:

a key arranged to freely swing in a vertical direction about a rotation axis provided on a board portion of the grand piano, the key having a longitudinal shape divided into a back portion and a front portion with respect to the rotation axis, wherein the front portion of the key is depressed by a performer and the back portion of the key is inserted into a key driving mechanism of the grand piano;

a capstan member projecting from a predetermined position on the back portion of the key;

a support arranged with a support rail placed above the back portion of the key such that the support can freely rotate in the vertical direction, the support having a clearance with the capstan member in an initial state of rotary motion of the key to occur in a key depression, wherein when key depression progresses, the capstan member comes into contact with a lower surface of the support, and the support is rotated responsive to movement of the key about another rotation axis which is provided at a connection point between the support and the support rail;

a jack interconnected with an edge portion of the support such that the jack can freely rotate, wherein the jack, responsive to rotary movement of the support, transmits a key depressing force applied to the key by the performer to a hammer which strikes a string; and a transmitting member by which the key depressing force is transmitted from the key to the hammer, the transmitting member being inserted between an upper surface of the key and a lower surface of the support, the transmitting member contacting with the upper surface of the key at a position between the capstan member and the rotation center of the key and contacting with the lower surface of the support at a position between a position at which the capstan member comes in contact with the support and a position at which the jack is connected to the support.

2. A muting device of a grand piano as defined in claim 1 wherein the transmitting member is a capstan screw.

3. A muting device of a grand piano comprising:

a key arranged to freely swing in a vertical direction about a rotation axis provided on a board portion of the grand piano, the key having a longitudinal shape which is divided into a back portion and a front portion with respect to the rotation axis, wherein the front portion of the key is depressed by a performer, while the back portion of the key is inserted into a key driving mechanism of the grand piano;

a hammer shank interconnected with a shank rail provided on the board portion of the grand piano such that the hammer shank can freely rotate in the vertical direction, the hammer shank supporting a hammer which strikes a string;

a key-depressing-force-transmitting-mechanism which is inserted between and contacted with the key and the hammer shank so as to transmit key depressing force applied to the key by the performer to the hammer shank;

a string-striking-stroke-reducing-means for, in a non-key-depression state, rotating the hammer shank to thereby reduce a string striking stroke by moving a set position of the hammer shank toward the string by a predetermined distance; and a load applying means for, when the string striking stroke is reduced, applying a predetermined load to the back portion of the key to thereby hold the key at a predetermined non-key-depression position.

* * * * *